United States Patent [19]

Belangie

[11] Patent Number: 4,824,283

[45] Date of Patent: Apr. 25, 1989

[54] SEALED HIGHWAY JOINT AND METHOD

[76] Inventor: Michael C. Belangie, 27 Q St., Salt Lake City, Utah 84103

[21] Appl. No.: 1,699

[22] Filed: Jan. 9, 1987

[51] Int. Cl.[4] ..... E01C 11/10; E01C 11/02

[52] U.S. Cl. ..... 404/64; 404/66; 404/74

[58] Field of Search ..... 404/49, 64–68, 404/47, 74

[56] References Cited

U.S. PATENT DOCUMENTS

| | | | |
|---|---|---|---|
| 1,885,391 | 11/1932 | Thompson et al. | 404/49 |
| 3,629,986 | 12/1971 | Klittich | 404/64 X |
| 3,827,204 | 8/1974 | Walters | 404/66 X |
| 3,866,384 | 2/1975 | Peterson, Jr. et al. | 404/74 X |
| 3,870,424 | 3/1975 | Koester et al. | 404/67 |
| 4,287,696 | 9/1981 | Mullen | 404/64 X |
| 4,601,604 | 7/1986 | Clark et al. | 404/69 |
| 4,699,540 | 10/1987 | Gibbon et al. | 404/49 |

OTHER PUBLICATIONS

"Wide Top Cut Features Slab Joints"; Engineering News Record; Mar. 16, 1961; p. 49.

*Primary Examiner*—Jerome W. Massie
*Assistant Examiner*—Matthew Smith
*Attorney, Agent, or Firm*—Mallinckrodt & Mallinckrodt

[57] ABSTRACT

A sealed joint in a concrete highway or the like is installed in a channel formed above the usual shrinkage control cut between adjoining concrete slabs by depositing a mass of uncured ductile and elastic adhesive, preferably a special silicone material, in such channel and embedding a preformed length of a cured ductile and elastic material, again preferably a special silicone material, in such adhesive. The length is preferably of strip formation and has intermediate areas of its upper and lower surfaces covered with respective fillers of an anti-bonding agent to provide for joint expansion and retraction. The joint installation channel is preferably unusually shallow and may be dry cut. Its width is sufficiently narrow that traffic loads are carried by the concrete bordering the channel. Preformed strip is introduced into the adhesive in the channel from a stable roll of same.

14 Claims, 2 Drawing Sheets

SEALED HIGHWAY JOINT AND METHOD

BACKGROUND OF THE INVENTION

1. Field:

The invention is in the field of weather and/or traffic resistance joints between adjoining structural slab materials, especially in concrete highways, and of methods of making same.

2. State of the Art:

Many different ways of making joints of the type concerned have been proposed heretofore to overcome the various problems associated with interconnecting adjoining slab materials. Of special concern has been the providing of both weather and traffic resistance joints in concrete highways.

It has become common practice to cut expansion joint channels transversely and/or longitudinally in a concrete highway by the use of diamond saws, and to introduce a more or less hard-setting but ductile and elastic silicone adhesive into such channel cuts as a joint filler above a semi-rigid backer bar insert. As a weather proofing agent, the adhesive will adhere to the opposed concrete facings of such cuts and after curing into final hardness will tend to move with the expanding and contracting adjoining concrete slabs. It is usual to clean the channel cuts by flushing with water followed by high pressure water blast or sand blast prior to introducing the silicone adhesive. Although certain silicone formulations designated for highway use are presently available commercially from several manufacturers on the basis of long-range testing showing several years of generally trouble-free performance under heavy traffic conditions, the reduction of costs associated with the construction and replacement of such joints, together with improvements in performance, have been the subject of considerable research activity by government highway departments and by suppliers of materials thereto considering the tremendous number of such joints necessitated by the many miles of concrete highway in most countries of the world.

Preformed and precompressed lengths of various elastomer materials have been introduced into joint installation channels for sealing purposes with only indifferent success.

SUMMARY OF THE INVENTION

In accordance with the present invention, improvements in cost and performance are attainable by a combination of a ductile and elastic adhesive, usually a silicone, with a preformed and relaxed length of a heat-curved ductile and elastic material, also usually a silicone, in an installation channel cut or otherwise provided in the concrete at and above the usual shrinkage-control cut or construction joint. Such preformed length is usually and preferably of strip form. The installation channel is sufficiently narrow that traffic loads are carried by the concrete bordering such channel. Although a somewhat similar preformed waterstop is shown by Weber, U.S. Pat. No. 4,127,350 of Nov. 28, 1978, in combination with a covering of a rigid-setting grout material serving as both a filler and a hold-down for the waterstop, the installation is in a concrete highway expansion joint channel of width such that the grout, which extends upwardly in the channel to flush with the highway surface, bears traffic loads.

In the present invention, the preformed length rests on and is surrounded by adhesive material and is ordinarily covered, at least laterally, by the adhesive material. An intermediate portion of the width of the length that extends over the line of slab joinder has anti-bonding material applied thereto so as to provide upper and lower expansion and contraction areas for such length that are free of bond with the adhesive material.

The preformed length is preferably a strip rectangular in cross section with or without an attenuated intermediate portion, in which instance it can be wound on itself as a compact roll following forming by extrusion or otherwise so that it can be easily handled prior to installation. If otherwise irregularly formed to have a nonrectangular cross section, a feature of the invention is the utilization of a filler, such as a paper material, to fill out the irregularities and permit stabilized winding into a roll for handling purposes, the filler being removed at the time of installation.

A significant optional feature of the invention to cost advantage is the cutting of an installation channel in adjoining concrete slabs that is unusually shallow in comparison with conventional installation channel depth as customarily used with a bar-backed silicone adhesive joint filler alone. In other words, the invention makes possible the use of such a shallow installation channel, which can be cut dry by diamond saws, above and across the usual relatively deep shrinkage control cut at the joint. This not only saves on expensive silicone adhesive material, but eliminates the usual flushing and pressure cleaning with water followed by drying.

THE DRAWING

The best mode presently contemplated for carrying out the invention in actual practice is illustrated in the accompanying drawing, in which:

FIG. 1 is a fragmentary view in perspective of a highway joint in accordance with the invention looking from a vertical section taken perpendicularly across the joint, the view being drawn to a considerably enlarged scale with a portion broken out for convenience of illustrating.

FIG. 2, a view in perspective taken similarly with respect to the preformed strip of FIG. 1 per se, the strip having been wound into a roll for ease of handling prior to installation in the joint of FIG. 1;

FIG. 3, a similar view of a corresponding strip preformed with attenuated intermediate section for expansion and contraction;

FIG. 4, another similar view of a strip that is non-rectangular in cross section to which filler material has been applied to produce rectangular cross section for stability of winding into roll information;

FIG. 5, still another similar view of a strip of different non-rectangular cross section similarly filled for stability of winding and FIG. 6, a view corresponding to that of FIG. 1 but showing a deeper joint installation channel with a conventional backer rod below the sealing joint.

DETAILED DESCRIPTION OF ILLUSTRATED EMBODIMENTS

Figure 1:
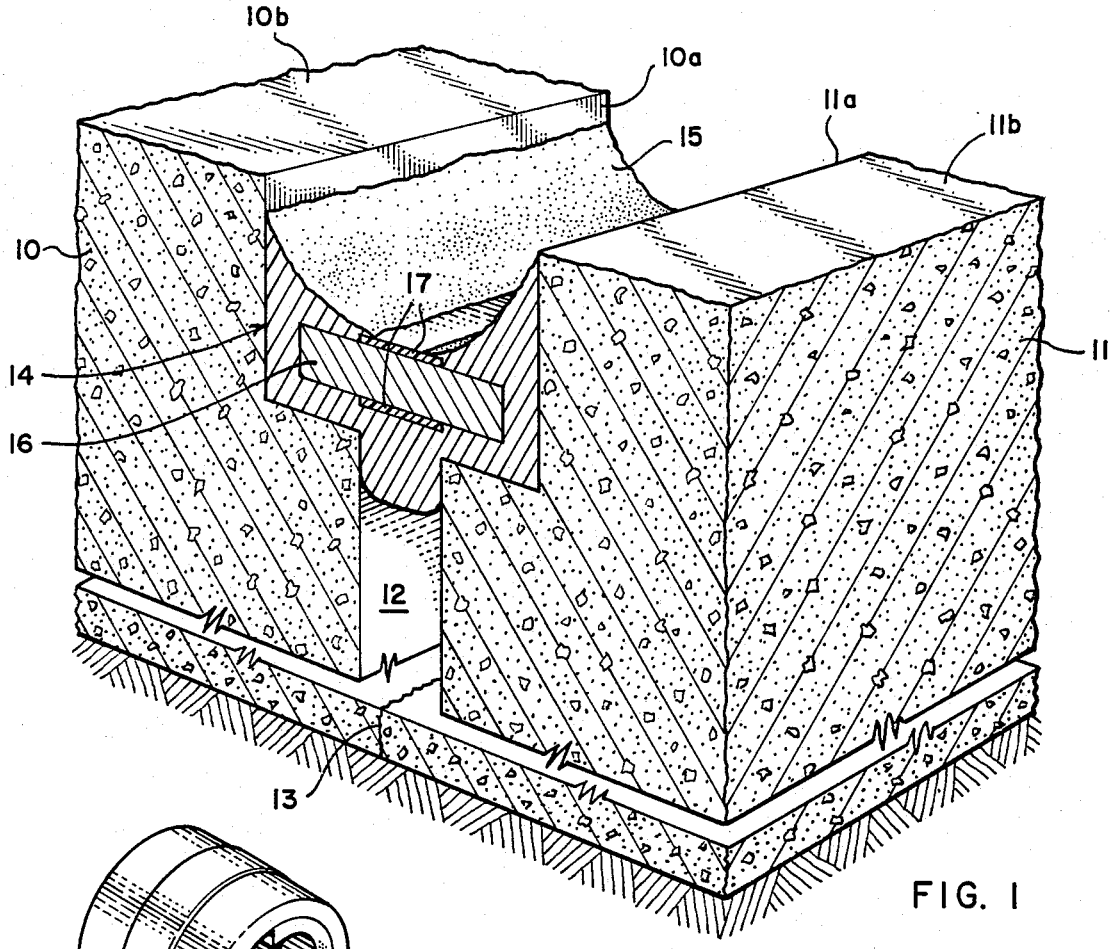

In FIG. 1 is shown a fragmentary section of a typical concrete highway laid down as a continuous length in which cuts are made for accommodating expansion and contraction of adjoining concrete slab sections, here indicated 10 and 11, brought about my reason of changing weather conditions. A usual shrinkage control cut 12, typically one-eighth of an inch in width, is first made to a depth of typically three to four inches transversely across or longitudinally of the concrete as laid to a customary depth of from eight to twelve inches. It is common practice to make the cut 12 by use of a diamond saw. This results in a break 13 through the remaining depth of the concrete to provide the slabs 10 and 11 as separate but closely adjoining entities. A sealing joint installation channel 14 is then cut along the length of and extending across the shrinkage control cut 12.

Figure 6:
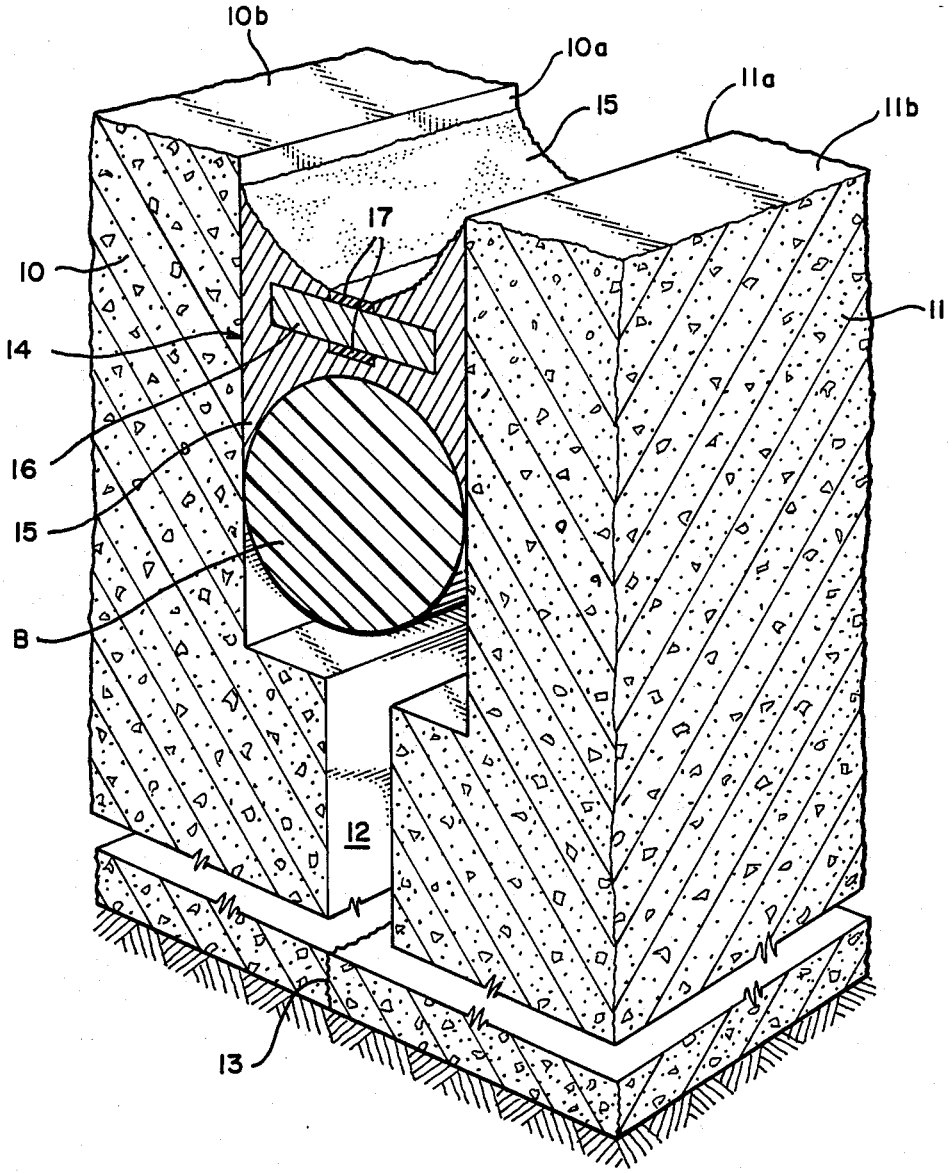

In the present instance, such joint installation channel 14 is made shallower than customary, for the usual backer rod is purposely omitted. However, in some instances it may be preferred to make the joint installation channel of usual depth and install a backer rod, e.g. in customary manner, followed by installation of a sealing joint of the invention as described hereinafter, all as shown in FIG. 6, with the backer rod indicated by B and other parts by the same reference numbers as in the previous figures.

The joint installation channel 14 may be cut wet, i.e. while flushing the diamond saw with water in customary manner, but is preferably cut dry to save cost and time in flushing and drying. This is possible because of the shallowness of cut, i.e. within a depth range of from about one-quarter to three-eighths of an inch depending upon channel width which may vary between about three-eights to one-half inch, the wider the channel the deeper the cut. This width is sufficiently small, or in other words channel 14 is sufficiently narrow, that traffic loads will be carried by the concrete bordering the channel rather than by the material of the sealing joint.

Following dry cutting, the cut channel may be cleaned by sand by sand blasting or high pressure air blast, neither of which requires prolonged drying as in wet cutting. Installation of the sealing joint can take place immediately.

As here shown, the sealing joint installed in channel 14 above, along, and across shrinkage control cut 12 comprises a mass 15 of preferably a special silicone adhesive similar to but stronger in its cured state than standard forms that are often referred to as RTV silicone. This is depicted in channel 14, as by a caulking gun, and is commercially obtainable from Mobay Chemical Co., Pittsburgh, Pa., under the commercial designation Mobay Baysilone 400. Dow Chemical Co. makes an RTV silicon under the name of Dow 888, as does General Electric Co. under the name of GE 4404 and Mobay Chemical Co. under the name of Mobay Baysilone Highway Sealant. These are not recommended for use in this invention because of lower than desired strength in the cured state.

Embedded in the mass of adhesive and extending along channel 14 and across shrinkage control cut 12 is a preformed and heat cured strip 16 of silicone that can be spoken of as an HTV silicone in contrast to RTV Silicone, a field cured adhesive. A useable material of this kind is obtainable from Jamak, Inc., Weatherford, Texas, under the name of Solasil System preformed sealant. For use in the present invention, such preformed strip material should be supplied with thin films 17 of an adhesive anti-bonding material, such as a polyethelene plastic, applied to and along an intermediate area thereof at opposite faces of the strip. Such areas are approximately the width of the shrinkage control cut 12, i.e. about one-eighth of an inch, and positioned so as to be substantially coextensive with the opening of such shrinkage control cut. The width of strip 16 should be somewhat less than the width of channel 14, e.g. as shown, as the embedded strip will not only rest upon but will be surrounded by silicone adhesive 15.

Such silicone adhesive 15 should cover lateral portions of the upper surface of strip 16 and should contact the channel-defining side wall faces 10*a* and 11*a* of the adjoining concrete slabs 10 and 11 for bonding thereto, somewhat as illustrated in FIG. 1, but desirably should not cover either the upper or the lower intermediate anti-bonding area 17, although relatively thin portions of such adhesive 15 that may inevitably lap over opposite margins of such areas or even completely thinly cover such areas will be of little concern due to the anti-bonding action of films 17. The adhesive 15 may or may not completely cover the concrete faces 10*a* and 11*a*, but should not rise above or lap over onto the highway surfaces 10*b* and 11*b*. That the bottom of the bed may tend to sag into the shrinkage control cut 12 as shown, is immaterial except for the fact that it is advantageous that as little as possible underlie the anti-bonding area 17.

The intermediate portion of strip 16 covered by anti-bonding films 17 is free for extension and retraction to accommodate extension and retraction of the adjoining slabs of concrete, the opposite marginal portions of the strip being held tightly by the cured adhesive 15.

In making the sealing joint of the invention, strip 16 may be laid onto a predeposited bed of the adhesive 15, or onto beads thereof spaced apart at opposite sides of the opening of shrinkage control cut 12 so there will be a minimum of coverage of the lower film 17, and the remainder of the adhesive added thereafter, or the entire amount of the adhesive may be deposited in installation channel 14 and the strip pushed into place thereafter. In either instance, it is desirable that the strip as preformed, for example by extrusion through a suitable die for subsequent curing by the application of heat, and following application of anti-bonding films 17 thereto, be wound upon itself in roll form a shown in FIGS. 2–5 for convenience in handling and storage prior to sealing joint construction and for ease of installation.

Figure 2:
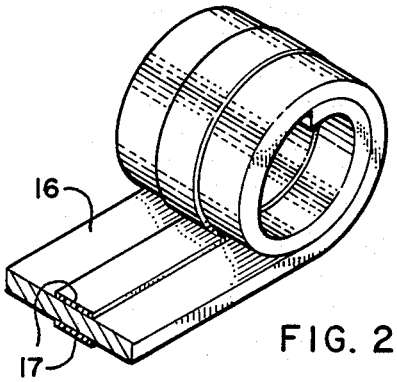
Figure 3:
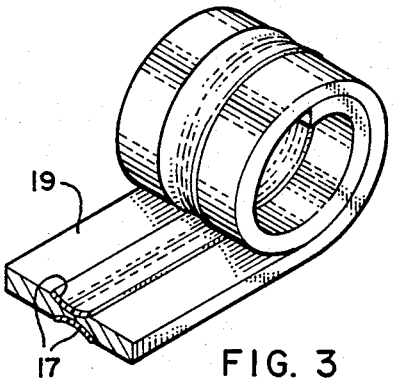
Figure 4:
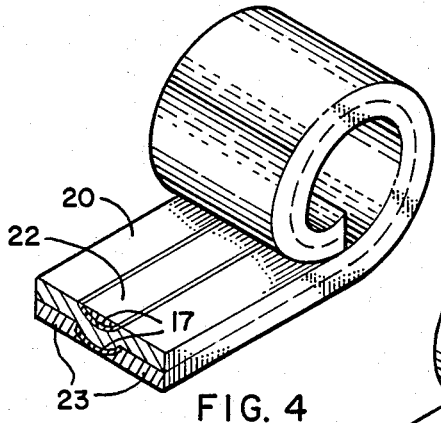
Figure 5:
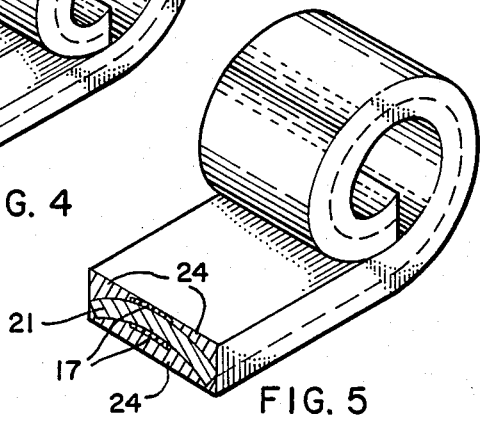

With the strip configured rectangularly in cross section, as is 16, FIGS. 1 and 2, there is no problem in making a stable roll, nor is there a problem when the anti-bonding intermediate area of the strip is attenuated as shown at 18 in the strip 19 of FIG. 3, which strip is of generally rectangular cross-section. However, with other strip shapes that are irregular in the sense that they are non-rectangular in cross-section, winding on themselves would produce an unstable roll. Accordingly, in the latter instance, as shown by the varied shapes of strip 20, FIG. 4, and of strip 21, FIG. 5, which are exemplary of the various possible shapes that the strip may take if found desirable in particular instances, a filler or fillers of some easily stripable and disposable material, such as a preformed paper material, is applied to the strip to make it substantially rectangular in cross section or at least with smooth and parallel flat faces for winding into a stable roll. Thus, in FIG. 4 fillers 22 and 23 are applied to strip 20 before winding into a roll, while in FIG. 5 fillers 24 and 25 are applied to strip 21.

When a backer rod is employed, as at B in FIG. 6, it may be of usual type, such as that produced by Hercules Incorporated, Wilmington, Del., under the designation HBR, cylindrical in formation and made up of a foamed plastic material having a surface film of a plastic such as polyethyelene. As usual, it may have a diameter slightly greater than the width of the joint installation channel, which in this instance is of greater depth than that of the prior figures, and is pushed downwardly in such channel a desired distance leaving sufficient depth above for installation of the sealing joint of the invention.

Whereas this invention is here illustrated and described with specific reference to embodiments thereof presently contemplated as the best mode of carrying out such invention in actual practice, it is to be understood that various changes may be made in adapting the invention to different embodiments without departing from the broader inventive concepts disclosed herein.

RELATED APPLICATION

Claims herein are specifically restricted to the best mode illustrated and described utilizing an anti-bonding material with the relaxed, preformed length of ductile and elastic material. Generic claims are made in copending continuation-in-part application Ser. No. filed May 4, 1988.

I claim:

1. A sealed joint between adjoining slabs of concrete in a highway or other area subject to vehicular traffic, the slabs being separated by a shrinkage-control cut or by a construction joint, said sealed joint comprising a joint installation channel wider than and above and extending along and across said cut or construction joint, said channel having a width sufficiently narrow that traffic loads are carried by the concrete bordering said channel rather than by said sealed joint; a mass of ductile and elastic type of adhesive deposited in said channel along its length and across its width and bonded to the concrete facings which define said channel; and a relaxed, preformed length of a heat-cured ductile and elastic material embedded in said adhesive and spanning said cut or construction joint and extending therealong, said preformed length having an intermediate portion carrying an anti-bonding material over a width approximating the width of said cut or construction joint and substantially coextensive therewith, said adhesive being bonded to said preformed length except where covered by said anti-bonding material.

2. A sealed joint according to claim 1, wherein the joint installation channel is unusually shallow in its depth, i.e. in the range of about one-fourth to about three-eighths of an inch, relative to the depth of the shrinkage-control cut or construction joint.

3. A sealed joint according to claim 1, wherein a semi-rigid backer rod is positioned in the joint installation channel below the specified components of the sealed joint.

4. A sealed joint according to claim 1, wherein the preformed length is a strip rectangular in cross section.

5. A sealed joint according to claim 4, wherein the preformed strip is in the range of about one-sixteenth to about one-eighth of an inch in thickness.

6. A sealed joint according to claim 5, wherein the intermediate portion of the preformed strip is attenuated throughout substantially the width of the anti-bonding material.

7. A sealed joint according to claim 1, wherein the width of the joint installation channel is in the range of from about three-eighths to about one-half inch and the depth is in the range of from about one-fourth to about three-eighths of an inch.

8. A sealed joint according to claim 1, wherein the adhesive is less ductile and modulus of elasticity greater than is the preformed length.

9. A sealed joint according to claim 8, wherein the adhesive is an RTV silicone and the preformed length is an HTV silicone.

10. A method of making a sealed joint between adjoining slabs of concrete in a highway or the like that are separated by a shrinkage-control cut or by a construction joint, comprising the steps of forming a sealed joint installation channel wider than and above and extending along and across said cut or construction joint, said channel having a width sufficiently narrow that traffic loads are carried by the concrete bordering said channel rather than by said sealed joint; depositing a mass of a ductile and elastic uncured adhesive within said channel along its length and across its width for bonding to the concrete facings which define said channel; embedding into said mass of uncured adhesive a preformed length of heat-cured ductile and elastic material in relaxed condition, said preformed length being manipulated so as to extend over at least a width approximately the width of said cut or construction joint and carrying an adhesive anti-bonding material over a width approximating the width of said shrinkage-control cut or construction joint and substantially coextensive therewith; and bonding said adhesive to said length except in those areas covered by said anti-bonding material.

11. A method according to claim 10, wherein the preformed length is a strip of rectangular configuration in cross-section wound on itself as a roll, and is embedded in the uncured adhesive as it is being unrolled.

12. A method according to claim 10, wherein the preformed length is a strip non-rectangular formation in cross section which is made rectangular in cross section by the application thereto of a filler material; wherein the filled strip is wound on itself as a roll; and wherein the preformed strip is embedded in the uncured adhesive as it is being unrolled and following removal of the filler material therefrom.

13. A sealed joint according to claim 1, wherein the adhesive deposited in the joint installation channel covers and is bonded to the upper surface of the preformed length but leaves the anti-bonding-material-protected intermediate portion thereof substantially uncovered by said adhesive.

14. A method of making a sealed joint according to claim 10, wherein the adhesive is deposited in the joint installation channel so as to cover and bond to the upper surface of the preformed length substantially only where such surface is not protectively covered by the anti-bonding material along the intermediate portion thereof.

* * * * *